US006418739B2

(12) United States Patent
Cho et al.

(10) Patent No.: US 6,418,739 B2
(45) Date of Patent: Jul. 16, 2002

(54) REFRIGERATOR AND METHOD FOR CONTROLLING THE SAME

(75) Inventors: Sung-ho Cho, Kwangju; Jung-hee Park, Anyang; Jae-seung Lee, Suwon, all of (KR)

(73) Assignee: Samsung Electronics, Co., Ltd., Suwon (KR)

( * ) Notice: Subject to any disclaimer, the term of this patent is extended or adjusted under 35 U.S.C. 154(b) by 0 days.

(21) Appl. No.: 09/752,767

(22) Filed: Jan. 3, 2001

(30) Foreign Application Priority Data

Feb. 9, 2000 (KR) ..... 00-6040
Oct. 5, 2000 (KR) ..... 00-58578

(51) Int. Cl.[7] ..... F25D 17/04
(52) U.S. Cl. ..... 62/187; 62/408
(58) Field of Search ..... 62/186, 187, 131, 62/177, 408, 407

(56) References Cited

U.S. PATENT DOCUMENTS 5,201,888 A * 4/1993 Beach, Jr. et al. ..... 62/187
5,524,447 A * 6/1996 Shim ..... 62/187 X
5,816,061 A * 10/1998 Lee et al. ..... 62/187
5,876,014 A * 3/1999 Noritake et al. ..... 62/408 X
5,992,166 A 11/1999 Tremblay ..... 62/187
6,101,826 A * 8/2000 Bessler ..... 62/408 X

* cited by examiner

*Primary Examiner*—Harry B. Tanner
(74) *Attorney, Agent, or Firm*—Robert E. Bushnell, Esq.

(57) ABSTRACT

Disclosed is a refrigerator comprising a main body formed with at least one cooling chamber and an evaporator, and a cool air duct forming a cool air path guiding cool air from the evaporator into the fresh food compartment, the refrigerator further comprising a damper plate rotatably installed in the cool air duct, opening and closing the cool air path; a damper driving motor rotating the damper plate; a temperature sensor sensing an inner temperature of the cooling chamber; and a controller controlling the damper driving motor so as to open and close the damper plate, based on an open degree of the damper plate predetermined according to the inner temperature sensed by the temperature sensor. With this configuration, there are provided a refrigerator efficiently controlling the inner temperature of the cooling chamber and a method for controlling the same.

18 Claims, 8 Drawing Sheets

REFRIGERATOR AND METHOD FOR CONTROLLING THE SAME

CLAIM OF PRIORITY

This application makes reference to, incorporates the same herein, and claims all benefits accruing under 35 U.S.C. §119 from my applications entitled Refrigerator And Control Method Thereof filed with the Korean Industrial Property Office on Feb. 9, 2000 and there duly assigned Ser. No. 2000-6040 and filed with the Korean Industrial Property Office on Oct. 5, 2000 and there duly assigned Ser. No. 2000-58578.

BACKGROUND OF THE INVENTION

1. Field of the Invention

The present invention relates to a refrigerator and a method for controlling the same.

2. Description of the Related Art

Referring to FIG. 1 which is a side sectional view of a refrigerator, the refrigerator is comprised of a main body 1 formed with a fresh food compartment 3 and a freezer compartment 5, and doors 7 and 9 installed in front of the main body 1, opening and closing the fresh food compartment 3 and the freezer compartment 5. In the rear lower part of the main body 1 is provided a component chamber 30 accommodating therein a compressor 31 compressing a refrigerant and a condenser (not shown).

In the rear of the freezer component 5 are provided an evaporator 15 generating cool air by means of the refrigerant from the compressor 31 and an evaporator accommodating part 10 accommodating the evaporator 15 therein.

The evaporator accommodating part 10 includes a rear cover 11 and a front cover 13. The rear cover 11 is spaced from the rear wall of the freezer compartment 5 at a predetermined interval and the front cover 13 is spaced from the rear cover 11 at a predetermined interval, having cool air discharge holes. On the rear lower part of the rear cover 11 is provided a supporter 12 supporting the evaporator 15. Above the upper part of the evaporator 15 is installed a fan 17 blowing the cool air generated from the evaporator 15 into the freezer compartment 5.

In the rear of the inner wall of the main body 1 are provided a cool air duct 40 and a cool air circulation duct 43. The cool air duct 40 includes a cool air path 41 guiding the cool air generated from the evaporator 15 into the fresh food compartment 3, and the cool air circulation duct 43 guides the air passing through the fresh food compartment 3 toward the evaporator 15. The cool air duct 40 extends toward the rear wall of the fresh food compartment 3 from the evaporator accommodating part 10 positioned in the rear of the freezer compartment 5, and the cool air circulation duct 43 extends toward the evaporator 15 from the rear lower part of the fresh food compartment 3.

In the cool air duct 40 is installed a damper 150 opening and closing the cool air path 41 so as to control an inner temperature of the fresh food compartment 3. In the fresh food compartment 3 is installed a temperature sensor 20 sensing the inner temperature of the fresh food compartment 3. In the main body 1 is provided a controller (not shown) controlling an operation of the damper 150 so as to allow the damper 150 to open and close the cool air path 41 according to the inner temperature of the fresh food compartment 3, the temperature being sensed by the temperature sensor 20.

FIG. 2 is a sectional view taken along line—of FIG. 1, showing the conventional damper 150. As shown therein, the conventional cool air duct 40 is comprised of a cool air hole communicating with the cool air path 41. The conventional damper 150 is comprised of a damper plate 151 opening and closing the cool air hole 42, and a driving means 153 installed in one end of the damper plate 151, adjusting opening and closing of the damper plate 151. The driving means 153 is comprised of a solenoid having a plunger (not shown). Between the damper plate 151 and the driving means 143 is provided an elastic plate 154. One end of the elastic plate 154 is installed in the damper plate 151 and the other end thereof is installed in the plunger (not shown).

When the refrigerator starts to operate, the temperature sensor 20 senses an inner temperature of the fresh food compartment 3. If the sensed inner temperature of the fresh food compartment 3 is higher than a predetermined temperature, the controller drives the driving means 153 to wholly open the cool air path 41. If the cool air path 41 is entirely opened, the cool air generated from the evaporator 15 is supplied into the fresh food compartment 3 through the cool air path 41, to thereby decrease the inner temperature of the fresh food compartment 3 so as not to exceed the predetermined temperature.

If the sensed inner temperature of the fresh food compartment 3 is not higher than the predetermined temperature, the controller activates the driving means 153 to wholly close the cool air path 41. If the cool air path 41 is entirely closed, the cool air from the evaporator 15 cannot be supplied into the fresh food compartment 3, to thereby allow the inner temperature thereof not to be lower than the predetermined temperature.

In the conventional refrigerator, the damper plate is structured simply to wholly open and close the cool air path of the cool air duct, so that it is difficult to appropriately adjust the amount of the cool air supplied into the cooling chamber according to the inner temperature of the cooling chamber, thereby being unable to effectively control the inner temperature of the cooling chamber.

SUMMARY OF THE INVENTION

The present invention has been made keeping in mind the above-described problem, and an object of the present invention is to provide a refrigerator capable of efficiently controlling an inner temperature of a cooling chamber, and a method for controlling the temperature.

This and other objects of the present invention may be achieved by a provision of a refrigerator comprising a main body formed with at least one cooling chamber and an evaporator, and a cool air duct forming a cool air path guiding cool air from the evaporator into the cooling chamber, further comprising a damper plate rotatably installed in the cool air duct, opening and closing the cool air path; a damper driving motor rotating the damper plate; a temperature sensor sensing an inner temperature of the cooling chamber; and a controller controlling the damper driving motor so as to open and close the damper plate, based on an open degree of the damper plate predetermined according to the inner temperature sensed by the temperature sensor.

The damper driving motor is installed outside the cool air duct, and the damper plate is of substantially rectangular and planar shape, corresponding to a sectional shape of the cool air duct, and it is installed inside the cool air path, and is rotatably coupled to a rotational shaft of the damper driving motor.

The refrigerator further comprises a damper rotation sensing part having a magnet coupled to a rotational shaft of the damper driving motor, generating a rotation signal, and a damper rotation speed sensor installed adjacent to the rotational shaft, sensing the rotation speed of the rotational shaft of the damper driving motor by means of the rotation signal from the magnet.

The damper rotation sensing part senses the open degree of the damper plate by means of the rotation speed detected by the rotation speed sensor and rotation time of the damper driving motor.

The controller controls the damper driving motor so as to allow the damper plate to have an open degree appropriate for the sensed inner temperature, by comparing the open degree of the damper plate sensed by the damper rotation sensing part and the predetermined open degree of the damper plate.

The controller controls the rotation time of the damper driving motor so as to adjust the open degree of the damper plate.

According to another aspect of the present invention, this and other objects may be achieved by a provision of a method for controlling a refrigerator comprising a main body formed with at least one cooling chamber and an evaporator, a cool air duct forming a cool air path guiding cool air from the evaporator into the cooling chamber, a damper plate rotatably installed in the cool air duct, opening and closing the cool air path, and a damper driving motor rotating the damper plate, comprising the steps of sensing the inner temperature of the cooling chamber to predetermine an open degree of the damper plate according to a sensed inner temperature; sensing the open degree of the damper plate; comparing the open degree of the damper plate predetermined according to the inner temperature and the sensed open degree of the damper plate; and controlling the damper driving motor so as to open the damper plate with the predetermined open degree.

In the step of sensing the open degree of the damper plate, rotation time of the damper driving motor is sensed, to determine the open degree of the damper plate.

In the step of controlling the damper driving motor, rotation time of the damper driving motor is controlled.

This and other objects of the present invention may also be achieved by a provision of a refrigerator comprising a main body formed with at least one cooling chamber and an evaporator, and a cool air duct forming a cool air path guiding cool air from the evaporator into the fresh food compartment, further comprising a damper plate rotatably installed in the cool air duct, opening and closing the cool air path; a damper driving motor rotating the damper plate; a frequency detector detecting the frequency of power supplied to the damper driving motor; a temperature sensor sensing an inner temperature of the cooling chamber; and a controller controlling power supply to the damper driving motor according to an open degree of the damper plate predetermined based on the sensed inner temperature and a power supply time set up based on the detected frequency.

The refrigerator further comprises a damper rotation sensing part having a magnet coupled to a rotational shaft of the damper driving motor, generating a rotation signal, and a damper rotation speed sensor installed adjacent to the rotational shaft, sensing the rotation speed of the rotational shaft of the damper driving motor by means of the rotational signal from the magnet.

The frequency detector detects the frequency of the power based on the rotation speed of the damper plate sensed by the damper rotation sensing part.

The controller determines a wholly opened point and a wholly closed point of the damper plate, based on the rotation speed of the damper plate sensed by the damper rotation sensing part, and controls the open degree of the damper plate according to the sensed inner temperature.

This and other objects of the present invention may also be achieved by a provision of a method for controlling a refrigerator comprising a main body formed with at least one cooling chamber and an evaporator, a cool air duct forming a cool air path guiding cool air from the evaporator into the cooling chamber, a damper plate rotatably installed in the cool air duct, opening and closing the cool air path, and a damper driving motor rotating the damper plate with power supply, comprising the steps of detecting the frequency of the power supply to the damper driving motor; sensing an inner temperature of the cooling chamber; and determining an open degree of the damper plate based on the sensed inner temperature, determining power supply time based on the open degree and the detected frequency, and supplying the power to the damper driving motor for the determined power supply time.

In the step of detecting the frequency, the frequency of the power supply is determined based on a rotation speed of the damper driving motor detected by dividing the rotation angle of the damper plate by the power supply time to the damper driving motor.

In the step of determining the open degree of the damper plate, the controller determines a wholly opened point and a wholly closed point of the damper plate based on a rotation degree of the damper plate sensed by a damper rotation sensing part and the detected frequency of the power supply.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
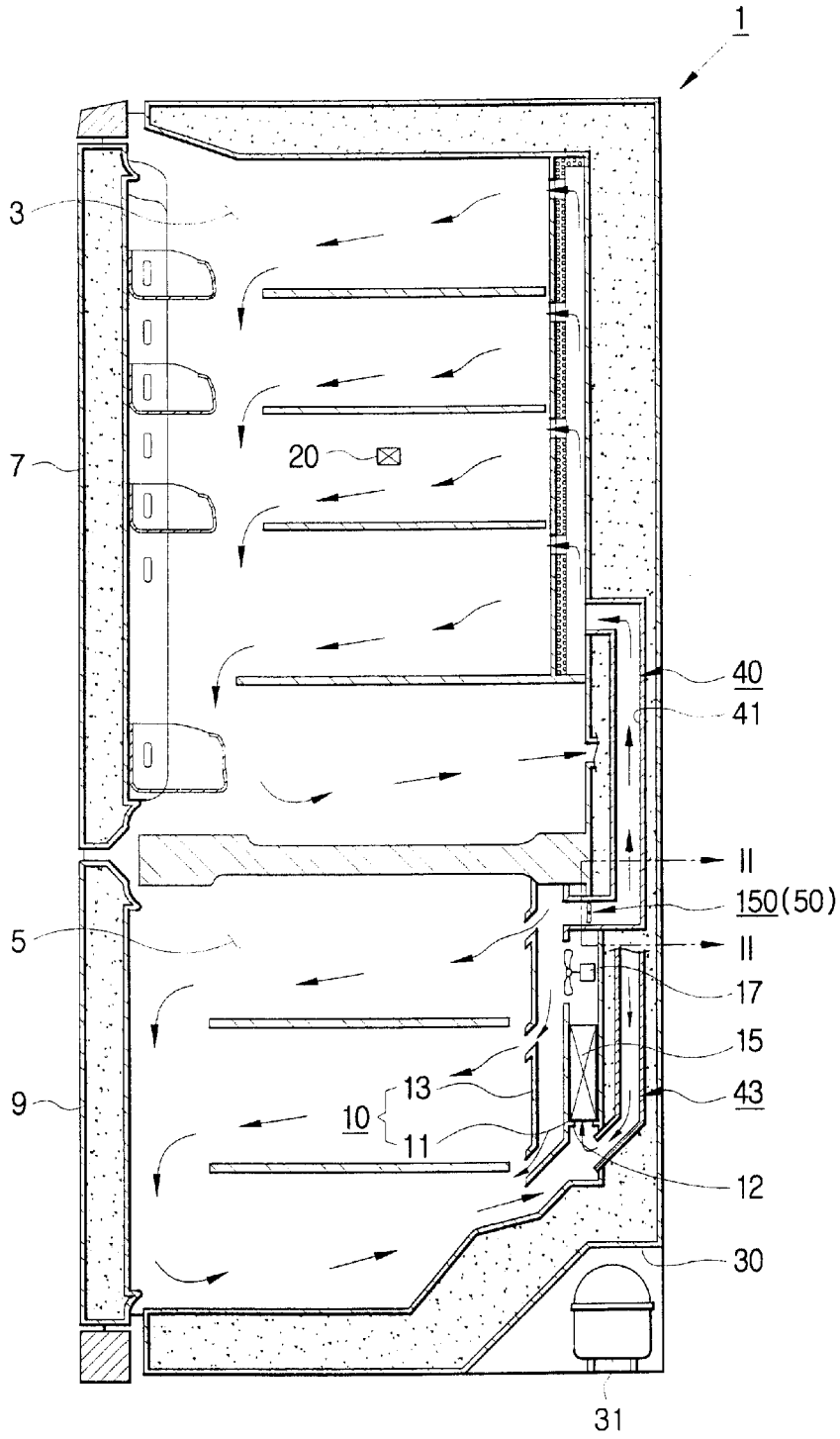
FIG. 1 is a side sectional view of a refrigerator.
Figure 2:
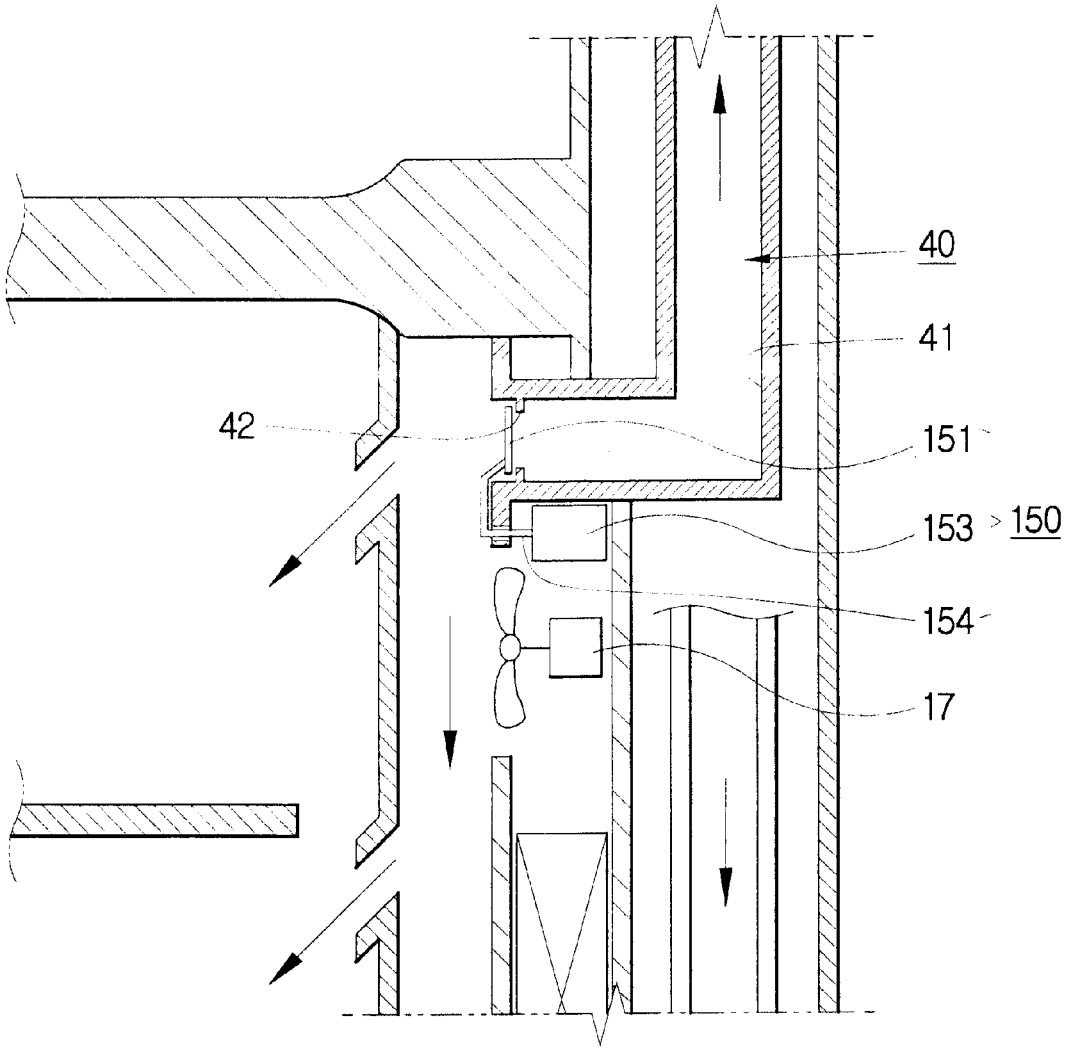
FIG. 2 (PRIOR ART)
FIG. 2 is a sectional view taken along line—of FIG. 1, showing a damper installed in a conventional refrigerator.
Figure 3:
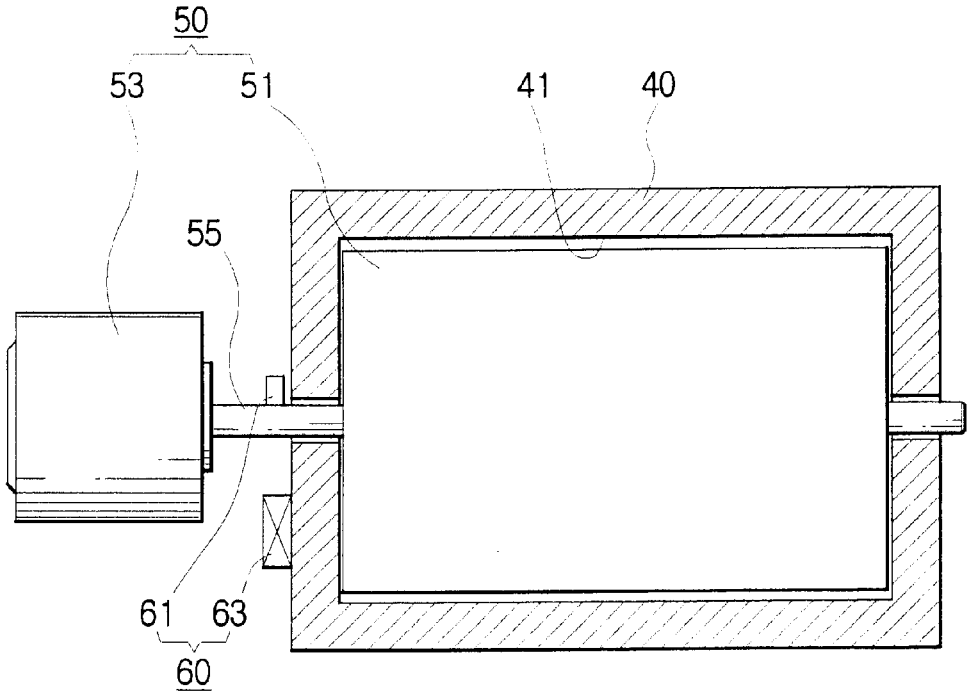
FIG. 3 is a sectional view taken along line—of FIG. 1, showing a damper installed in a refrigerator according to the present invention.
Figure 4:
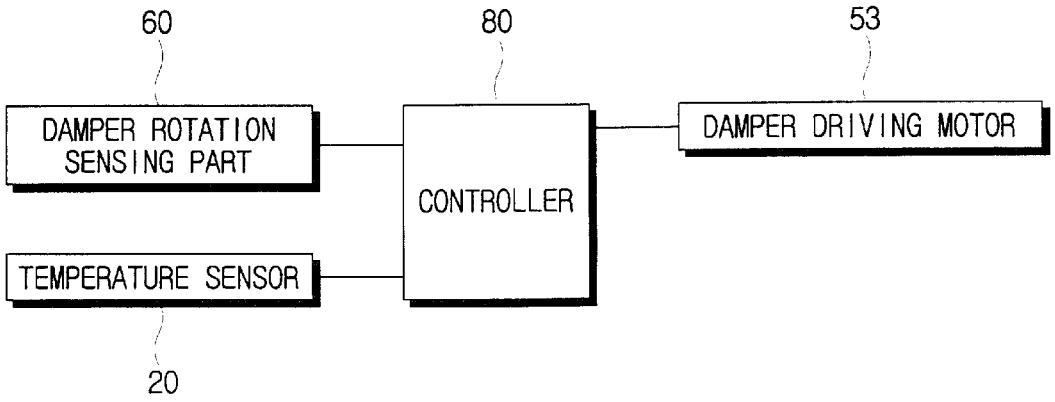
FIG. 4 is a block diagram showing a temperature control of a refrigerator according to a first embodiment of the present invention.

Referring to FIGS. 3 and 4, a refrigerator according to a first embodiment of the present invention is comprised of a damper 50 opening and closing a cool air path 41 of a cool air duct 40, which is activated by means of an external power, a temperature sensor 20 (see FIG. 4) installed in a fresh food compartment 3 (see FIG. 1), sensing an inner temperature of the fresh food compartment 3, and a controller 80 controlling driving of the damper 50 based on the temperature of the fresh food compartment 3 sensed by the temperature sensor 20.

The damper 50 is comprised of a damper plate 51 rotatably installed in the cool air duct 40, a damper driving motor 53 rotating the damper plate 51, and a damper rotation sensor 60 sensing rotation of the damper plate 51. The damper plate 51 is substantially of planar shape, corresponding to a sectional shape of the cool air duct 40, being coupled to a rotational shaft 55 of the damper driving motor 53 installed outside the cool air duct 40.

The damper rotation sensor 60 is comprised of a magnet 61 and a speed sensor 63. The magnet 61 is coupled to the rotational shaft 55 of the damper driving motor 53, generating rotation signals according to the rotation of the damper driving motor 53, and the speed sensor 63 is installed adjacent to the rotational shaft 55 of the damper driving motor 53, sensing a rotation speed of the rotational shaft 55 of the damper driving motor 53 by means of the rotational signal from the magnet 61.

The damper rotation sensor 60 senses the open degree of the damper plate 51 according to the rotation time of the damper driving motor 53. The process of sensing the open degree of the damper plate 51 is conducted in the following manner:

The speed sensor 63 senses the rotation speed of the damper driving motor 53 based on the rotation signal from the magnet 61, and determines the open degree of the damper plate 51 by detecting the rotation time of the damper driving motor 53 according to the sensed rotation speed.

For example, where the rotation speed of the damper driving motor 53 is 6 rpm, that is, the damper driving motor 53 is rotated with 360° for 10 seconds, if the rotation time of the damper driving motor 53 is 2.5 seconds, the damper plate 51 is rotated with 90°, allowing the cool air path 25 to maintain the wholly opened state. If the rotation time of the damper driving motor 53 is 5 seconds, the damper plate 51 is rotated with 180°, allowing the cool air path 41 to maintain the wholly closed state.

If the damper driving motor 53 is rotated for 7.5 seconds, the damper plate 51 is rotated with 270°, allowing the cool air path 41 to maintain the wholly opened state. If the damper driving motor 53 is rotated for 10 seconds, the damper plate 51 is rotated with 360°, allowing the cool air path 41 to maintain the wholly closed state.

As shown in FIG. 4, the controller 80 compares the open degree of the damper plate 51 sensed by the damper rotation sensor 60 and the open degree of the damper plate 51 predetermined according to the temperature of the fresh food compartment 3 sensed by the temperature sensor 20, and controls the damper driving motor 53 so that the open degree of the damper plate 51 conforms with the predetermined open degree thereof.

Hereinafter, a process of setting up an open degree of the damper plate 51 according to an inner temperature of the fresh food compartment 3 sensed by the temperature sensor 20 will be described.

First, the point when a sensed temperature is the set up minimum temperature of the fresh food compartment 3 is set up a wholly closed point of the damper plate 51, and the point when a sensed temperature is the set up maximum temperature of the fresh food compartment 3 is set up a wholly opened point of the damper plate 51. The temperature difference section between the set up minimum temperature and the set up maximum temperature and the displacement difference section between the wholly closed point and the wholly opened point of the damper plate 51 are uniformly divided into a plurality of sections of the same number. The open degree of the damper plate 51 is set up according to the temperature sections and the displacement sections.

For example, if the set up minimum temperature of the fresh food compartment 3 is 1 and the set up maximum temperature thereof is 6, the damper plate 51 entirely closes the cool air path 41 at 1, and entirely opens the cool air path 41 at 6. If the temperature difference section between the set up minimum temperature and the set up maximum temperature is divided into five sections of 1~2, 2~3, 3~4, 4~5 and 5~6, and the displacement difference section between the wholly closed section and the wholly opened section of the damper plate 51 are divided into five sections, the open degree of the damper plate 51 can be predetermined.

The controller 80 compares the open degree of the damper plate 51 sensed by the damper rotation sensor 60 (hereinafter, referred to as "a sensed open degree") and the open degree of the damper plate predetermined according to an inner temperature of the fresh food compartment 3 sensed by the temperature sensor 20 (hereinafter, referred to as "a set up open degree") to determine whether they are identical to each other. If the sensed open degree and the set up open degree are identical, the controller 80 does not activate the damper driving motor 53. If both open degrees are not identical, the controller 80 rotates the damper driving motor 53 so as to allow the damper plate 53 to have the setup open degree. The controller 80 controls the rotation time of the damper driving motor 53 so as to allow the damper plate 53 to have the set up open degree.

For example, if the respective temperatures of the set up minimum temperature and the set up maximum temperature of the fresh food compartment 3 are 1 and 6, the controller 80 can control supply time of power to the damper driving motor 53 by dividing 2.5 seconds, the time which is taken to wholly close the damper plate 41, into five sections.

If the inner temperature of the fresh food compartment raises by 1 when the inner temperature of the fresh food compartment 3 is the set up minimum temperature and the damper plate 51 is at the wholly closed point, the controller 80 can control the open degree of the damper plate 51 by opening the damper plate 51 by 18° for 0.5 seconds in view of the power supply time.

Figure 5:
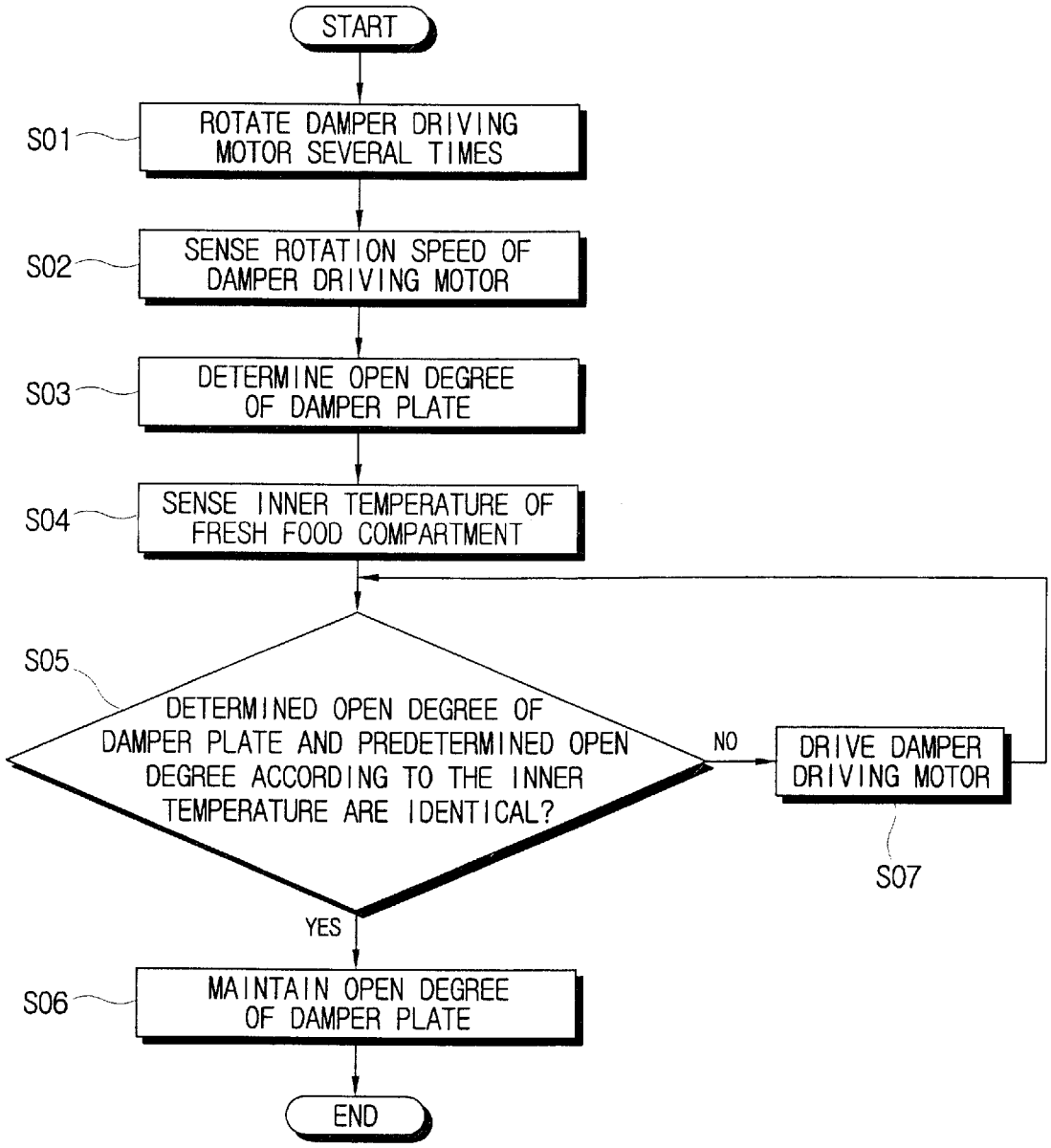
FIG. 5 is a flow chart illustrating a method for controlling a temperature of the refrigerator of FIG. 4.

Referring to FIG. 5, the controller 80 first rotates the damper driving motor 53 by 360° several times and then stops to operate the damper driving motor 53 (S01). The damper rotation sensor 60 senses the rotation speed of the damper driving motor 53 (S02), and the open degree of the damper plate 51 is determined based on the sensed rotation speed (S03).

For example, if it takes 10 seconds from the time when a rotation signal from the magnet 61 is sensed by the speed sensor 63, when the damper driving motor 53 is rotated, to the time when the rotation signal is sensed again by the speed sensor 63, and it takes 2.5 seconds from the time when the final rotation signal of the magnet 61 is sensed, to the time when the damper driving motor 53 stops to operate, the damper rotation sensor 60 can detect that the rotation speed of the damper driving motor 53 is 6 rpm and the damper plate 51 is at the wholly opened point.

The rotation speed of the damper driving motor 53 and the open degree of the damper plate 51 as sensed are transmitted to the controller 80, along with the inner temperature of the fresh food compartment 3 sensed by the temperature sensor 20 (S04). The controller 80 compares the sensed open degree of the damper plate 51 and the set up open degree of the damper plate 51 to determine whether they are identical (S05). If the set up open degree and the sensed open degree are identical, the controller does not operate the damper driving motor 53 so as to maintain the current open degree. If the set open degree and the sensed open degree are not identical, the controller rotates the damper driving motor 53 so as to make the sensed open degree and the set up open degree of the damper plate 51 identical (S07).

Figure 8:
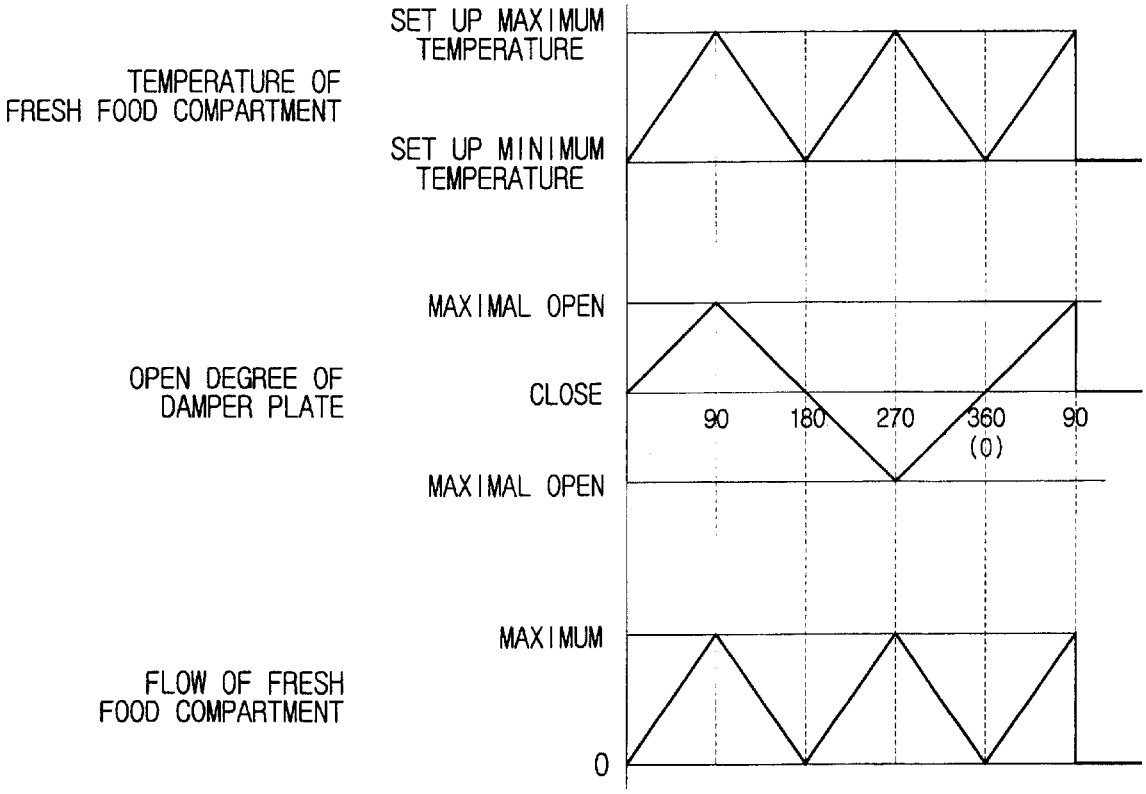
FIG. 8 is a graph showing the relation of the open degree of a damper plate and a temperature of the refrigerator according to the present invention.

Referring to FIG. 8, the relation between the sensed open degree of the damper plate 51 employed in the refrigerator according to the present invention and the temperature of the fresh food compartment 3 sensed by the temperature sensor 20 will be described below. As shown therein, when the inner temperature of the fresh food compartment 3 is higher than the set up minimum temperature or lower than the set up maximum temperature, the controller 80 controls the rotation time of the damper driving motor 53 to allow the open degree of the damper plate 51 to increase or decrease, so that the damper plate 51 has the set up open degree according to the temperature of the fresh food compartment 3. In response to decrease or increase in the open degree, the amount of air supplied to the fresh food compartment 3 adaptively decreases or increases, thereby adjusting the amount of air supply according to the inner temperature of the fresh food compartment 3, and further efficiently controlling the inner temperature of the fresh food compartment 3.

Figure 6:
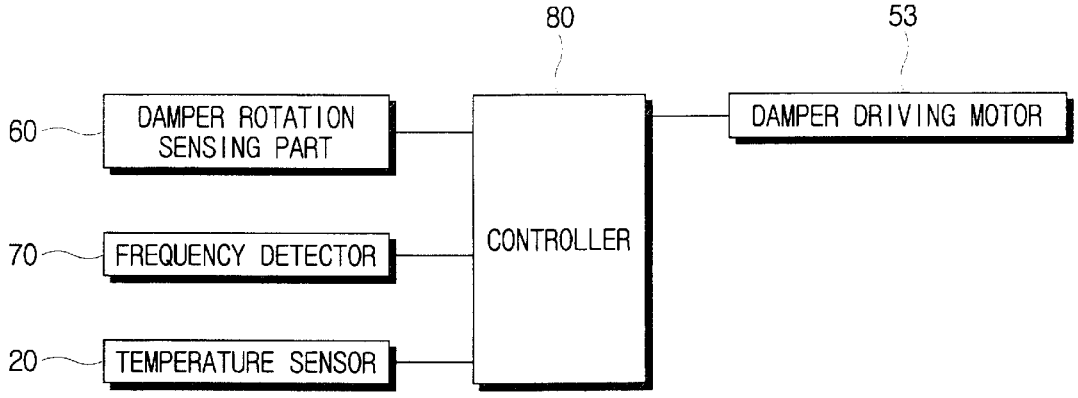
FIG. 6 is a block diagram showing a temperature control of a refrigerator according to a second embodiment of the present invention.

Referring to FIG. 6, a refrigerator according to a second embodiment of the present invention is comprised of a temperature sensor 20 sensing an inner temperature of the fresh food compartment 3 (see FIG. 1), and a frequency detector 70 detecting the frequency of the power supplied to the damper driving motor 53. The refrigerator is further comprised of a controller 80 setting up the open degree of the damper plate 51 based on the inner temperature of the fresh food compartment sensed by the temperature sensor 20, and controlling the damper driving motor 53 based on the set up open degree and the frequency detected by the frequency detector 70.

The frequency detector 70 detects the rotation speed of the damper driving motor 54 by dividing the rotational angle of the damper plate 51 sensed by the damper rotation sensor 60 into the power supply time to the damper driving motor 53, and detects the frequency of the power supplied based on the detected value.

For example, if it takes 10 seconds from the point when the rotation signal from the magnet 61 is sensed by the speed sensor 63 to the point when the signal is re-sensed after being rotated with 360°, the rotation speed of the damper plate 51 is 6 rpm. If the rotation speed of the damper plate 51 is 6 rpm, the frequency detector 70 detects the power supply of 60. If it takes 12 seconds from the point when the rotation signal from the magnet 61 is sensed by the speed sensor 63 to the point when the signal is re-sensed after being rotated with 360°, that is, if the rotation speed of the damper plate 51 is 5 rpm, the frequency detector 70 detects the power supply of 50.

If power is supplied to the damper driving motor 53 for 2.5 seconds or 7.5 seconds when the frequency of power supply detected in the frequency detector 70 is 60 , the controller 80 rotates the damper plate 51 so as to be at the wholly opened point. If power is supplied to the damper driving motor 53 for 0 second, 5 seconds and 10 seconds, the controller 80 rotates the damper plate 51 at the wholly closed point.

If power is supplied to the damper driving motor 53 for 3 seconds or 9 seconds when the power of 50 is supplied, the damper plate 51 is rotated so as to be at the wholly opened point. If power is supplied to the damper driving motor 53 for 0 second, 6 seconds and 12 seconds, the damper plate 51 is rotated at the wholly closed point.

The controller 80 determines the open degree of the damper plate 51 based on the inner temperature of the fresh food compartment 3 sensed by the temperature sensor 20 and supplies the power to the damper driving motor 53 according to the power supply time set up based on the open degree of the damper plate 51 and the frequency detected by the frequency detector 70, thereby controlling the rotation of the damper plate 51.

Figure 7:
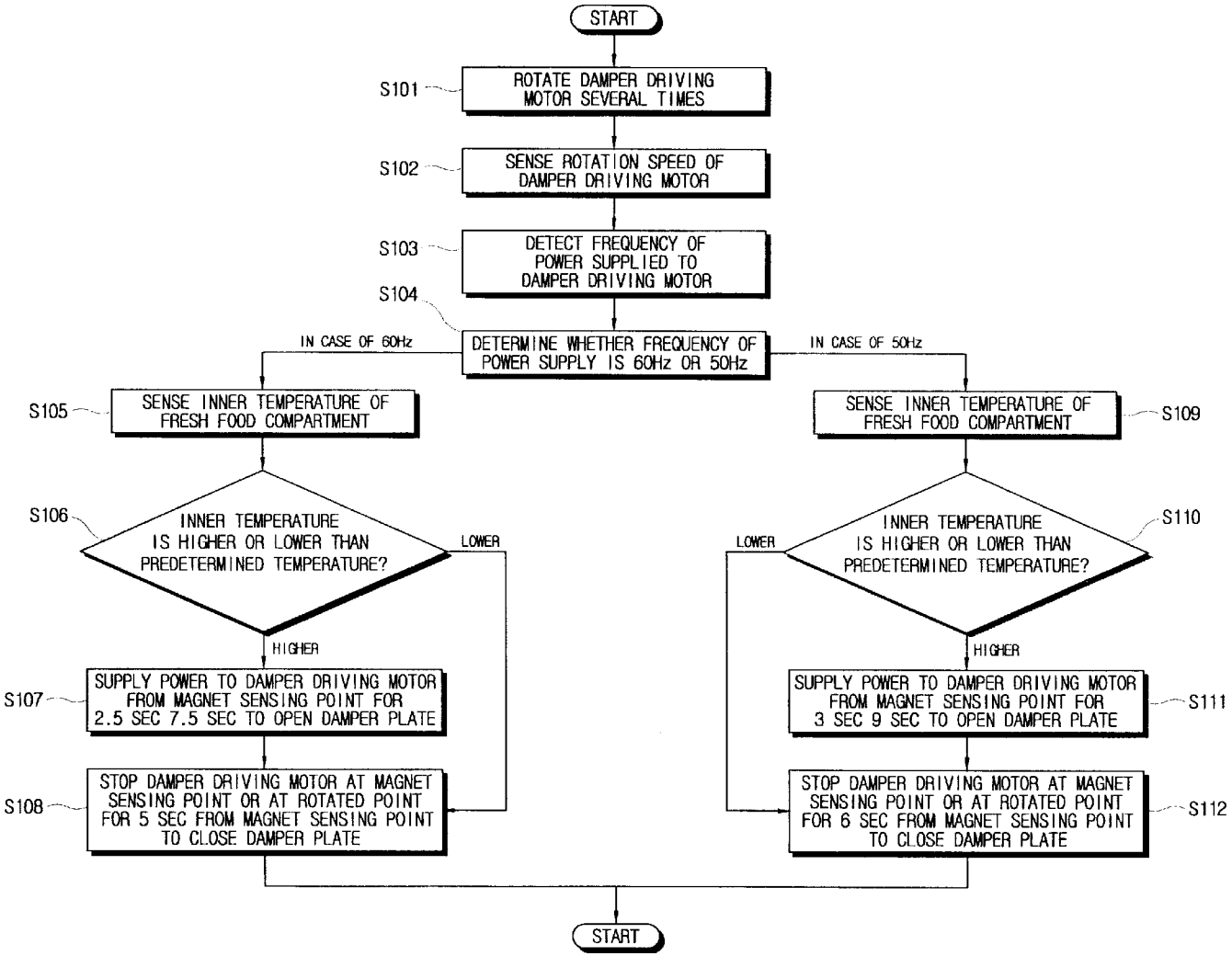
FIG. 7 is a flow chart illustrating a method for controlling a temperature of the refrigerator of FIG. 6.

Referring to FIG. 7, the method for controlling a temperature of a refrigerator shown in FIG. 6 will be described below. As shown, if the refrigerator starts to operate according to the second embodiment of the present invention, the controller 80 first rotates the damper driving motor 53 by 360° several times (S101). The damper rotation sensor 60 senses the rotation speed of the damper driving motor 53 (S102).

The frequency detector 70 detects the frequency of the power supplied to the damper driving motor 53 based on the rotation speed sensed by the damper rotation sensor 60 (S103), and determines whether the detected frequency is 60 or 50 (S104). In other words, if it takes 10 seconds for the damper driving motor 53 to make one revolution (the rotation speed is 6 rpm), the frequency detector 70 determines that the detected frequency of the power supply is 60. If it takes 12 seconds for the damper driving motor 53 to make one revolution (the rotation speed is 5 rpm), the frequency detector 70 determines that the detected frequency of the power supply is 50. If the frequency is determined to be 60 , the temperature sensor 20 senses the inner temperature of the fresh food compartment 3 and transmits the sensed temperature to the controller 80 (S105). Then, the controller 80 compares to determine whether the inner temperature of the refrigerator sensed by the temperature sensor 20 higher or lower than the predetermined temperature (S106). If the inner temperature of the fresh food compartment 3 is higher than the predetermined temperature, the controller 80 supplies the power to the damper driving motor 53 for 2.5 seconds or 7.5 seconds from the point when the rotational signal from the magnet 61 is sensed, thereby wholly opening the damper plate 51 (S107). If the sensed inner temperature of the fresh food compartment in the step S106 is determined to be lower than the predetermined temperature, the controller 80 supplies the power to the damper driving motor 53 for 5 seconds from the point when the rotational signal from the magnet 61 is sensed, thereby wholly closing the damper plate 51 (S108).

If the frequency of the power supply detected by the frequency detector 70 is determined to be 50, the inner temperature of the fresh food compartment 3 is sensed and transmitted to the controller 80 as in the step S105 (S109). It is determined whether the inner temperature of the fresh food compartment 3 sensed by the temperature sensor 20 is higher or lower than the predetermined temperature (S110). If the inner temperature of the fresh food compartment 3 is higher than the predetermined temperature, the controller 80 supplies the power to the damper driving motor 53 for 3 seconds or 9 seconds from the point when the rotational signal from the magnet 61 is sensed, thereby wholly opening the damper plate 51 (S111). If the sensed inner temperature of the fresh food compartment in the step S106 is determined to be lower than the predetermined temperature, the controller 80 supplies the power to the damper driving motor 53 for 6 seconds from the point when the rotational signal from the magnet 61 is sensed, thereby wholly closing the damper plate 51 (S112).

Accordingly, although the frequency of the power supply varies, the open degree of the damper plate 51 can be efficiently adjusted, thereby being able to maintain the temperature of the fresh food compartment at an optimum state.

With this configuration, the inner temperature of the cooling chamber can be efficiently adjusted by adjusting the open degree of the damper plate according to the inner temperature of the cooling chamber and controlling the damper driving motor according to the frequency of the power supply.

According to the present invention, a refrigerator efficiently controlling the inner temperature of the cooling chamber, and a method for controlling the same are provided. Additionally, a refrigerator capable of adjusting the open degree of the damper plate according to the inner temperature of the cooling chamber and the frequency of the power supply, and a method for controlling the same are provided.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A refrigerator comprising a main body formed with at least one cooling chamber and an evaporator, and a cool air duct forming a cool air path guiding cool air from the evaporator into the cooling chamber, further comprising:

a damper plate rotatably installed in the cool air duct, opening and closing the cool air path;

a damper driving motor rotating the damper plate;

a temperature sensor sensing an inner temperature of the cooling chamber; and a controller controlling rotation time of the damper driving motor so as to adjust an open degree of the damper plate, based on a predetermined open degree of the damper plate corresponding to the inner temperature sensed by the temperature sensor.

2. The refrigerator according to claim 1, said damper driving motor installed outside the cool air duct, said damper plate being of substantially rectangular and planar shape corresponding to a sectional shape of the cool air duct, said damper plate installed inside the cool air path and rotatably coupled to a rotational shaft of the damper driving motor.

3. A refrigerator comprising a main body formed with at least one cooling chamber and an evaporator, and a cool air duct forming a cool air path guiding cool air from the evaporator into the cooling chamber, further comprising:

a damper plate rotatably installed in the cool air duct, said damper plate opening and closing the cool air path;

a damper driving motor rotating the damper plate;

a temperature sensor sensing an inner temperature of the cooling chamber;

a controller controlling the damper driving motor so as to adjust an open degree of the damper plate, based on a predetermined open degree of the damper plate corresponding to the inner temperature sensed by the temperature sensor; and a damper rotation sensing part comprising a magnet coupled to a rotational shaft of the damper driving motor, said magnet generating a rotation signal, and a damper rotation speed sensor installed adjacent to the rotational shaft, sensing the rotation speed of the rotational shaft of the damper driving motor by means of the rotation signal from the magnet.

4. The refrigerator according to claim 3, said damper rotation sensing part sensing the open degree of the damper plate by means of the rotation speed detected by the rotation speed sensor and rotation time of the damper driving motor.

5. The refrigerator according to claim 3, said controller controlling the damper driving motor so as to allow the open degree of the damper plate sensed by the damper rotation sensing part and the predetermined open degree of the damper plate to be identical.

6. The refrigerator according to claim 4, said controller controlling the damper driving motor so as to allow the open degree of the damper plate sensed by the damper rotation sensing part and the predetermined open degree of the damper plate to be identical.

7. The refrigerator according to claim 5, said controller controlling rotation time of the damper driving motor so as to adjust the open degree of the damper plate.

8. The refrigerator according to claim 6, said controller controlling the rotation time of the damper driving motor so as to adjust the open degree of the damper plate.

9. A method for controlling a refrigerator comprising a main body formed with at least one cooling chamber and an evaporator, a cool air duct forming a cool air path guiding cool air from the evaporator into the cooling chamber, a damper plate rotatably installed in the cool air duct, opening and closing the cool air path, and a damper driving motor rotating the damper plate, comprising the steps of:

sensing an inner temperature of the cooling chamber to predetermine an open degree of the damper plate according to the sensed inner temperature;

sensing an open degree of the damper plate;

comparing the predetermined open degree and the sensed open degree of the damper plate; and controlling rotation time of the damper driving motor so as to open the damper plate with the predetermined open degree.

10. The method according to claim 9, said step of sensing the open degree of the damper plate further comprising the step of detecting the rotation time of the damper driving motor.

11. A refrigerator comprising a main body formed with at least one cooling chamber and an evaporator, and a cool air duct forming a cool air path guiding cool air from the evaporator into the cooling chamber, further comprising:

a damper plate rotatably installed in the cool air duct, opening and closing the cool air path;

a damper driving motor rotating the damper plate;

a frequency detector detecting the frequency of power supplied to the damper driving motor;

a temperature sensor sensing an inner temperature of the cooling chamber; and a controller controlling power supply to the damper driving motor according to an open degree of the damper plate predetermined based on the sensed inner temperature and a power supply time set up based on the detected frequency.

12. The refrigerator according to claim 11, further comprising a damper rotation sensing part having a magnet coupled to a rotational shaft of the damper driving motor, generating a rotation signal, and a damper rotation speed sensor installed adjacent to the rotational shaft, sensing the rotation speed of the rotational shaft of the damper driving motor by means of the rotational signal from the magnet.

13. The refrigerator according to claim 12, said frequency detector detecting the frequency of the power based on the rotation speed of the damper plate sensed by the damper rotation sensing part.

14. The refrigerator according to claim 13, said controller determining a wholly opened point and a wholly closed point of the damper plate, based on the rotation speed of the damper plate sensed by the damper rotation sensing part, and controlling the open degree of the damper plate according to the sensed inner temperature.

15. The refrigerator according to claim 12, said controller determining a wholly opened point and a wholly closed point of the damper plate, based on the rotation speed of the damper plate sensed by the damper rotation sensing part, and controlling the open degree of the damper plate according to the sensed inner temperature.

16. A method for controlling a refrigerator comprising a main body formed with at least one cooling chamber and an evaporator, a cool air duct forming a cool air path guiding cool air from the evaporator into the fresh food compartment, a damper plate rotatably installed in the cool air duct, opening and closing the cool air path, and a damper driving motor rotating the damper plate with power supply, comprising the steps of:

detecting a frequency of the power supply to the damper driving motor;

sensing an inner temperature of the cooling chamber; and determining an open degree of the damper plate based on the sensed inner temperature, determining power supply time based on the open degree and the detected frequency, and supplying power to the damper driving motor for the determined power supply time.

17. The method according to claim 16, said step of detecting the frequency further comprising the step of determining the frequency of the power supply based on a rotation speed of the damper driving motor detected by dividing the rotation angle of the damper plate by the power supply time to the damper driving motor.

18. The method according to claim 16, said step of determining the open degree of the damper plate further comprising the step of determining a wholly opened point and a wholly closed point of the damper plate based on a rotation degree of the damper plate sensed by a damper rotation sensing part and the detected frequency of the power supply.

* * * * *